US010588417B2

(12) United States Patent
Berube

(10) Patent No.: US 10,588,417 B2
(45) Date of Patent: Mar. 17, 2020

(54) HEAD SUPPORT AND METHOD OF USING THE SAME

(71) Applicant: VRAT Inc., Montreal, Quebec (CA)

(72) Inventor: Sylvain Berube, Quebec (CA)

(73) Assignee: VRAT INC., Montreal (CA)

( * ) Notice: Subject to any disclaimer, the term of this patent is extended or adjusted under 35 U.S.C. 154(b) by 0 days.

(21) Appl. No.: 15/903,169

(22) Filed: Feb. 23, 2018

(65) Prior Publication Data

US 2018/0242747 A1 Aug. 30, 2018

Related U.S. Application Data

(60) Provisional application No. 62/464,091, filed on Feb. 27, 2017.

(51) Int. Cl.
*A47C 7/38* (2006.01)
*A47C 16/00* (2006.01)

(52) U.S. Cl.
CPC ..... *A47C 7/383* (2013.01); *A47C 16/00* (2013.01)

(58) Field of Classification Search
CPC ..... A47C 7/383; A47C 16/00; A47C 7/38; A47C 7/36
USPC ..... 248/118, 118.5
See application file for complete search history.

(56) References Cited

U.S. PATENT DOCUMENTS 4,197,604 A * 4/1980 Nakamura ..... A47G 9/1045 446/72
D279,727 S * 7/1985 Mitchell ..... 446/27
D280,570 S * 9/1985 Stanley ..... D2/632
4,724,548 A * 2/1988 London ..... A41F 9/002 2/170
D297,750 S * 9/1988 Loudenslager ..... D21/623
5,371,909 A * 12/1994 McCarty ..... A47D 13/08 5/490
D370,585 S * 6/1996 Faithfull ..... D2/631
D371,600 S * 7/1996 Henry ..... 49/406
D377,815 S * 2/1997 Deprima ..... D2/823
6,837,860 B1 * 1/2005 Auletta ..... A61H 7/004 601/112
8,007,044 B1 8/2011 Dubey
D719,873 S * 12/2014 Gianfriddo ..... D11/160
2004/0045087 A1 3/2004 Morris
2014/0345057 A1 11/2014 Jensen
2018/0242747 A1 * 8/2018 Berube ..... A47C 16/00

FOREIGN PATENT DOCUMENTS

CN 201577930 U 9/2010
FR 2837437 A1 9/2003
WO WO-2006115994 A1 11/2006

* cited by examiner

*Primary Examiner* — Muhammad Ijaz
(74) *Attorney, Agent, or Firm* — Brouillette Legal Inc.; Robert Brouillette

(57) ABSTRACT

A head support is described. The head support has a foldable longitudinal middle section, configured to be folded between different user positions, and a first supporting section connected to a first distal extremity of the middle section. The first supporting section has a foldable flat surface palm section, at least 2 foldable longitudinal finger sections extending from a distal extremity of the flat surface palm section and a foldable longitudinal thumb section extending from a lateral side of the foldable flat palm surface. A method for supporting a head of a user is also described.

11 Claims, 12 Drawing Sheets

HEAD SUPPORT AND METHOD OF USING THE SAME

CROSS-REFERENCE TO RELATED APPLICATIONS

The present patent application claims the benefits of priority of U.S. Provisional Patent Application No. 62/464,091 entitled "HEAD SUPPORT AND METHOD OF USING THE SAME", and filed at the United States Patent and Trademark Office on Feb. 27, 2017, the content of which is incorporated herein by reference.

FIELD OF THE INVENTION

The present invention generally relates to a system for supporting the head of a person, more particularly to a head support or headrest for supporting the head, for instance during transportation.

BACKGROUND OF THE INVENTION

The main idea of the headrest derived from the natural human habit of giving rest/support to the head with both hands (while resting and sleeping in sitting position) by keeping their joined hands under the chin and around the cheeks and temple (making wide U shape). In this position the temples and cheeks rest on fingers and palm of the hands and the chin rests in the center middle/center joint of the two hands. Elbows of the hand resting on the thighs or on any object to give head stability to rest, sleep/nap.

Most headrest include thick cushioning and fit around the chin, neck or/and head which makes a person, such as a child, to feel uncomfortable, suffocated and tied up. Also the headrest known in the art may be provided with fastening elements that may irritate the neck and back.

The present invention aims to provide an easy way to support the head while maintain the person tied during transportation.

SUMMARY OF THE INVENTION

In one aspect, there is provided a head support comprising a foldable longitudinal middle section, configured to be folded between different user positions and a first supporting section connected to a first distal extremity of the middle section; the first supporting section comprising a foldable flat surface palm section, at least 2 foldable longitudinal finger sections extending from a distal extremity of the flat surface palm section, and a foldable longitudinal thumb section extending from a lateral side of the foldable flat palm surface.

The middle section and the foldable flat surface palm section may each comprise at least 2 foldable longitudinal rods. The longitudinal rods extend through a malleable material.

The middle section may further comprise at least one connector configured for keeping the longitudinal rods of such middle section at a set distance from one another.

Each of the at least 2 foldable longitudinal finger sections may comprise at least one foldable longitudinal rod attached to and extending from each of the at least 2 foldable longitudinal rods of the foldable flat surface palm section. The head support of claim 5, wherein the longitudinal rods extend through a malleable material.

The foldable longitudinal thumb section may comprise at least one foldable longitudinal rod attached substantially perpendicularly to at least 2 of the foldable longitudinal rods of the foldable flat surface palm section.

The head support may further comprise a second supporting section connected to a second distal extremity of the middle section, the second supporting section comprising a foldable flat surface palm section, at least 2 foldable longitudinal finger sections extending from a distal extremity of the flat surface palm section, and a foldable longitudinal thumb section extending from a lateral side of the foldable flat palm surface.

In another aspect, there is provided a method for supporting a head of a user, the method comprising the steps of

- providing a head support comprising a foldable longitudinal middle section and a supporting section connected to each distal extremity of the middle section; each supporting section comprising a foldable flat surface palm section, at least 2 foldable longitudinal finger sections extending from a distal extremity of the flat surface palm section and a foldable longitudinal thumb section extending from a lateral side of the foldable flat palm surface;
- folding the middle section and one supporting section of the head support around a body of the user; and
- placing another supporting section of the head support around the head of the user.

The step of placing another supporting section of the head support around the head of the user may comprise placing the foldable flat surface palm section of the head support around one of a temple or a cheek of the user.

The step of placing another supporting section of the head support around the head of the user further may comprise placing one of the at least 2 foldable longitudinal finger sections or foldable longitudinal thumb section around a front portion of the head of the user.

In another aspect, there is provided a head support comprising a foldable longitudinal middle section, configured to be folded between different user positions and two supporting sections, each supporting section:

- connected to a distal extremity of the middle section, and
- comprising a foldable flat surface palm section, 3 foldable longitudinal finger sections extending from a distal extremity of the flat surface palm section, and a foldable longitudinal thumb section extending from a lateral side of the foldable flat palm surface.

The middle section and the foldable flat surface palm section may each comprise 3 foldable longitudinal rods.

Each of the 3 foldable longitudinal finger sections may comprise at least one foldable longitudinal rod attached to and extending from each of the 3 foldable longitudinal rods of the foldable flat surface palm section.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

A novel head support and method of using the same will be described hereinafter. Although the invention is described in terms of specific illustrative embodiments, it is to be understood that the embodiments described herein are by way of example only and that the scope of the invention is not intended to be limited thereby.

The alleged invention is described below in reference with the attached drawings.

Figure 1:
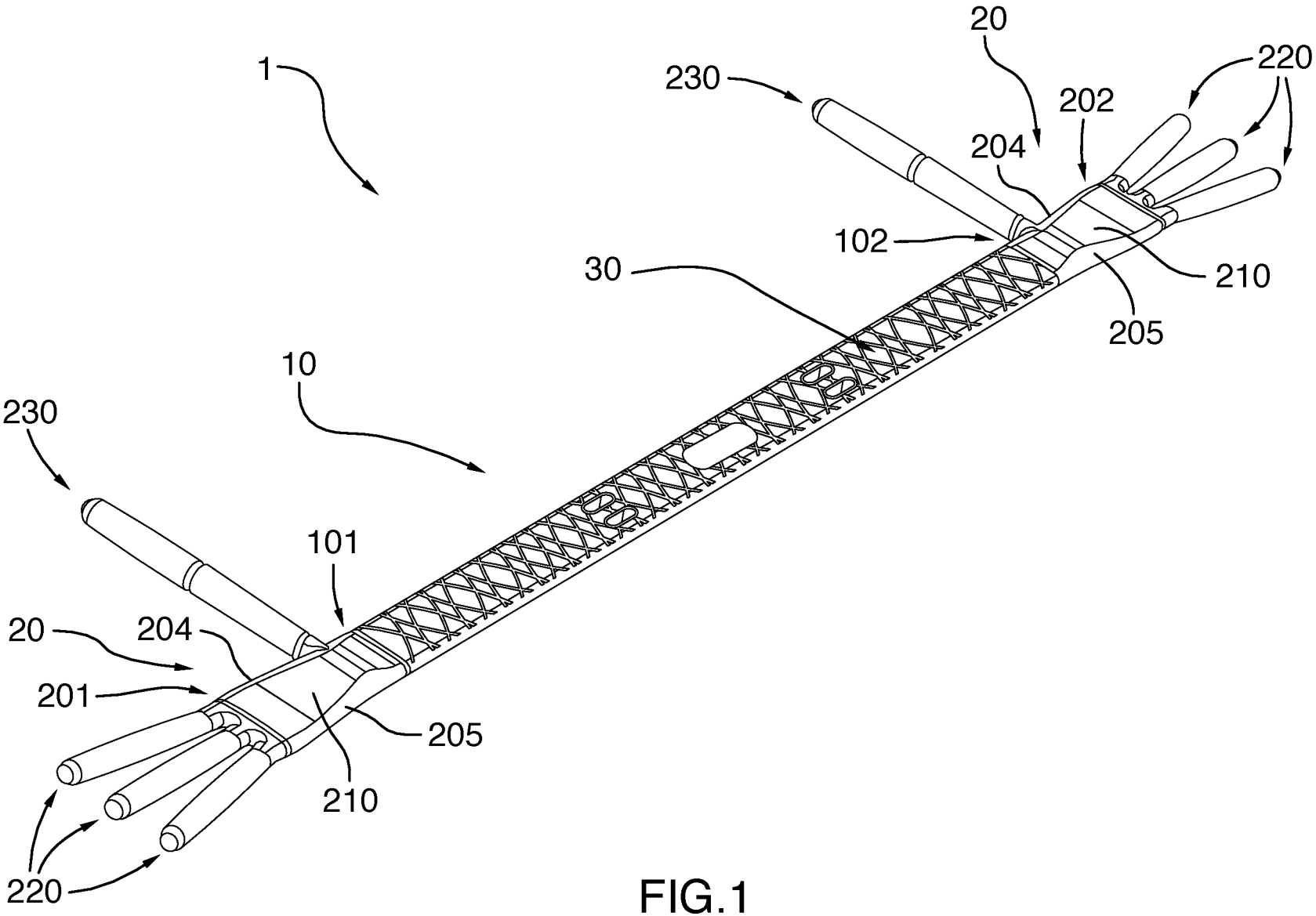
FIG. 1 is a perspective view of the head support in accordance with a preferred embodiment.

In reference to FIG. 1, according to a preferred embodiment, the present invention is a head support (1) for maintaining stable the head of a person, such as a child or kid, for instance during transportation in a car or a plane.

The head support (1) is a malleable structure which comprises a middle section (10) and one or two supporting sections (20), preferably having the shape of a pair of hands, each supporting section being connected at an end of the middle section. The middle structure (10), and preferably the supporting sections (20) are adapted to be easily deformable while remaining rigid.

The middle section (10) is a longitudinal section configured to be foldable between different user positions. The supporting sections (20) are attached at each distal extremity (101, 102) of the middle section (10). Each supporting section (20) comprises a foldable flat surface palm section (210), at least 2 foldable longitudinal finger sections (220), extending from a distal extremity (201, 202) of the flat surface palm section (210), and a foldable longitudinal thumb section (230) extending from a lateral side (204 or 205) of the foldable flat palm surface (210).

As illustrated on FIG. 1, the head support comprises a cover or glove (30) adapted for surrounding an internal structure (40) forming a skeleton. The skeleton is better visible and illustrated on FIGS. 2 to 4.

Figure 2:
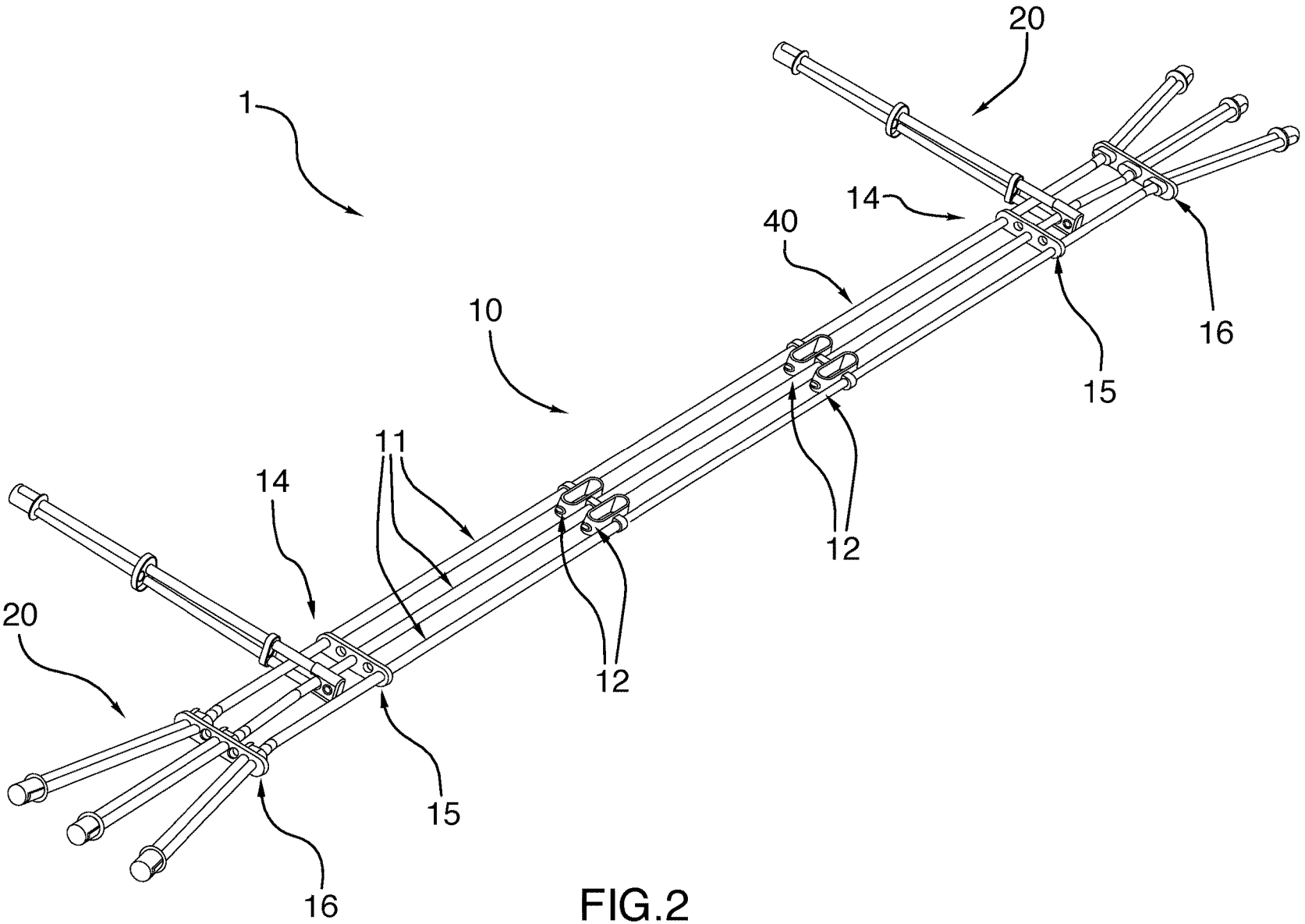
FIG. 2 is a perspective view of inside the head support without the cover in accordance with a preferred embodiment.
Figure 3:
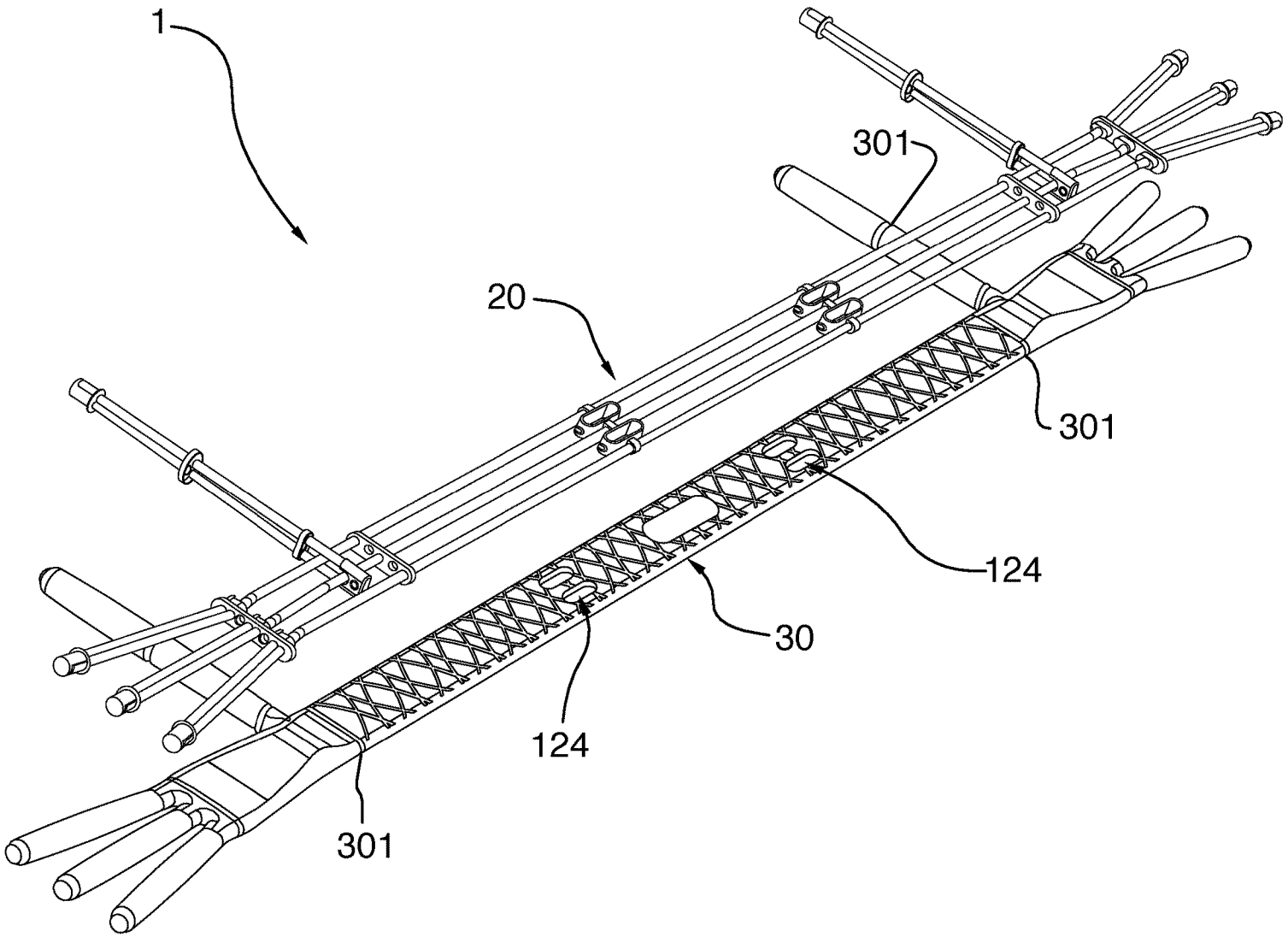
FIG. 3 is a perspective view of the inside of the head support and the cover in accordance with a preferred embodiment.
Figure 4:
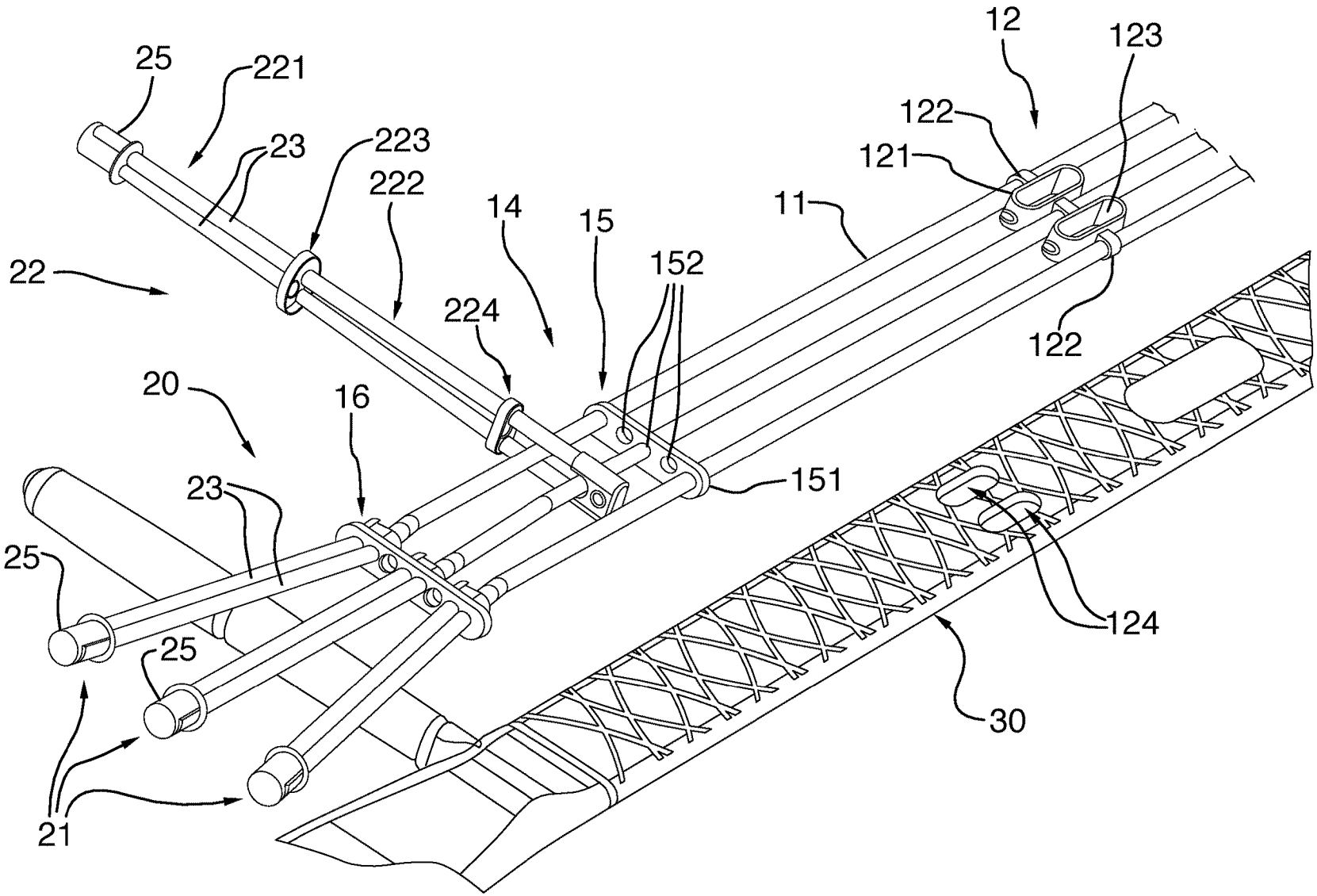
FIG. 4 is a detail of the hand section of the head support and cover in accordance with a preferred embodiment.
Figure 5B:
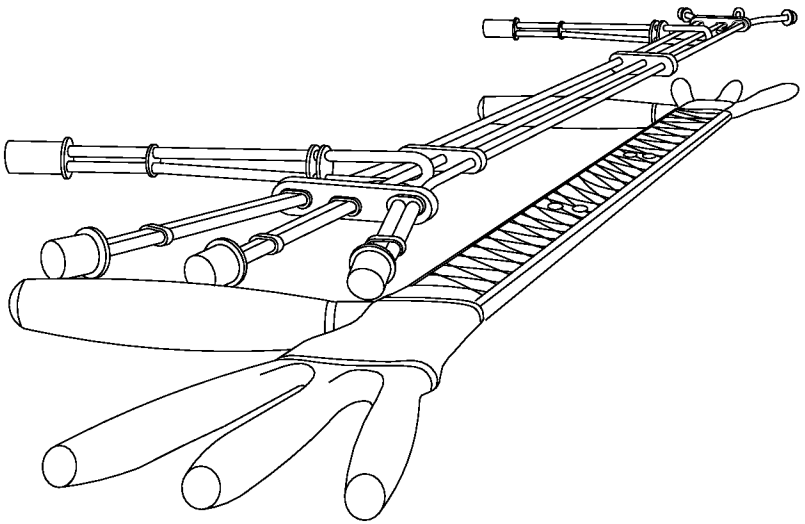
FIGS. 5 to 9 are 3D representations of a head support cover in accordance with another preferred embodiment.
Figure 5A:
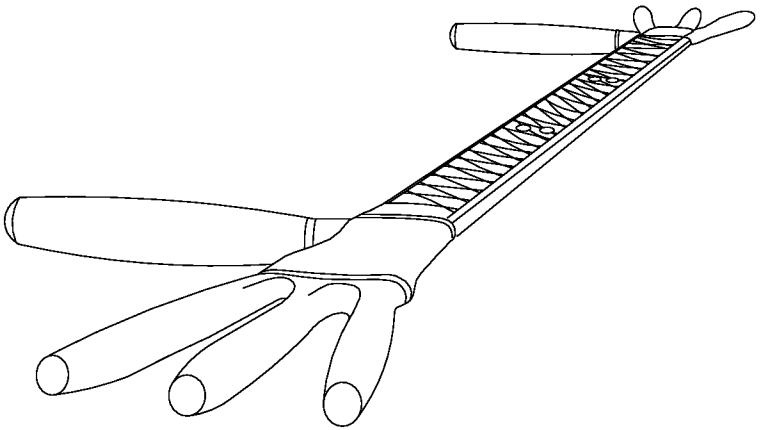

According to a preferred embodiment illustrated on FIGS. 2 to 4, the internal structure (40) comprises the middle section (10) with preferably has three longitudinal rods (11). The middle section may have a different number of rods without departing from the present invention. Preferably, the rods (11) are equally spaced and maintained one from another by the mean of a first type of connectors (12).

According to a preferred embodiment better illustrated on FIG. 4, the first type of connectors (12) has an oval or ellipsoid shape (121) with a longitudinal axis parallel to the longitudinal axis of the rods (11). The oval ring can be inserted between two adjacent rods (11) defining as such a specific distance between each rod (11). The first type of connectors (12) are fixed to the rods using clips (122) adapted to be clipped on the rods. Other way to fix the second type of connectors (12) to the rods (11) can be used without departing from the present invention.

The first type of connectors (12) may further comprise openings (123) formed by the oval ring. The cover (30) may also present the sort of openings (124) for matching the openings (123) of the oval rings once the cover is installed on the internal structure (40). As such, the openings (123, 124) can be used as anchor points to eventually attach the head support (1) to a fixing surface.

In order to ensure better mechanical properties and better rigidity of the rods assembling, the middle structure (10) may also comprise a second type of connectors (15) adjacent to the extremities (14) of the middle section, forming wrists.

According to a preferred embodiment better illustrated on FIG. 4, the second type of connectors (15) may comprise a rigid plate (151), preferably an oval plate, having its longitudinal axis perpendicular to the longitudinal axis of the rods (11). The plate defines a plurality of holes (152) spaced apart along the longitudinal axis. Each has a diameter configures to match the diameter of the rods (11). The rods are therefore maintained in place one from the other in a parallel configuration.

The middle structure (10) is preferably connected to both hands (20) by the mean of a third type of connectors (16) located at both extremities (14).

Still referring to FIG. 4, each supporting section (20) may form a structural hand. The hand may have three central fingers (21) and a lateral finger or thumb (22). Each finger may comprise two rods (23). Each finger (21) is attached at one extremity to the third type of connectors (16) and comprises at the other extremity a tip (25). The tips (25) allow maintaining the rods of the fingers together while protecting the face of a user when in contact with the hand.

Still referring to FIG. 4, the lateral finger or thumb (22) also comprises two rods (23) with an extremity fixed with the tip (25). The rods of the opposite extremity of the thumb spaced apart two rods entrapped at least two rods (11) of the middle structure (10). That way, the thumb can slide on the rods allowing choosing an adequate positioning of the thumb. Such a configuration offers more flexibility for the positioning of the thumb (22) allowing better accommodating a user head. Preferably, the lateral finger (22) is situated between the second and third type of connectors (15, 16).

According to a preferred embodiment, the rods forming the thumb (22) may comprise different subsections forming phalanges (221, 222) connected thanks to connectors (223) and (224) forming the finger joints. The connectors (223, 224) are thus configured to bend at the finger joints whereby in use the thumb can adapt to the form of the user's head.

As aforesaid, and illustrated on FIG. 3, the head support (1) may comprise a protective cover of glove (30) to cover all the surface of the middle sections, a hands and thumbs. Such a cover (30) is preferably made of malleable, deformable material, such as silicone, and adapted to be safely in contact with the human skin. The surface of the cover (30) may define several grooves (301) operatively matching to the sections of the internal structure where the internal structure can bend, such as a wrist joint or finger joints.

FIGS. 5 to 9 shows a prototype of the head support in accordance with another preferred embodiment.

Figure 6:
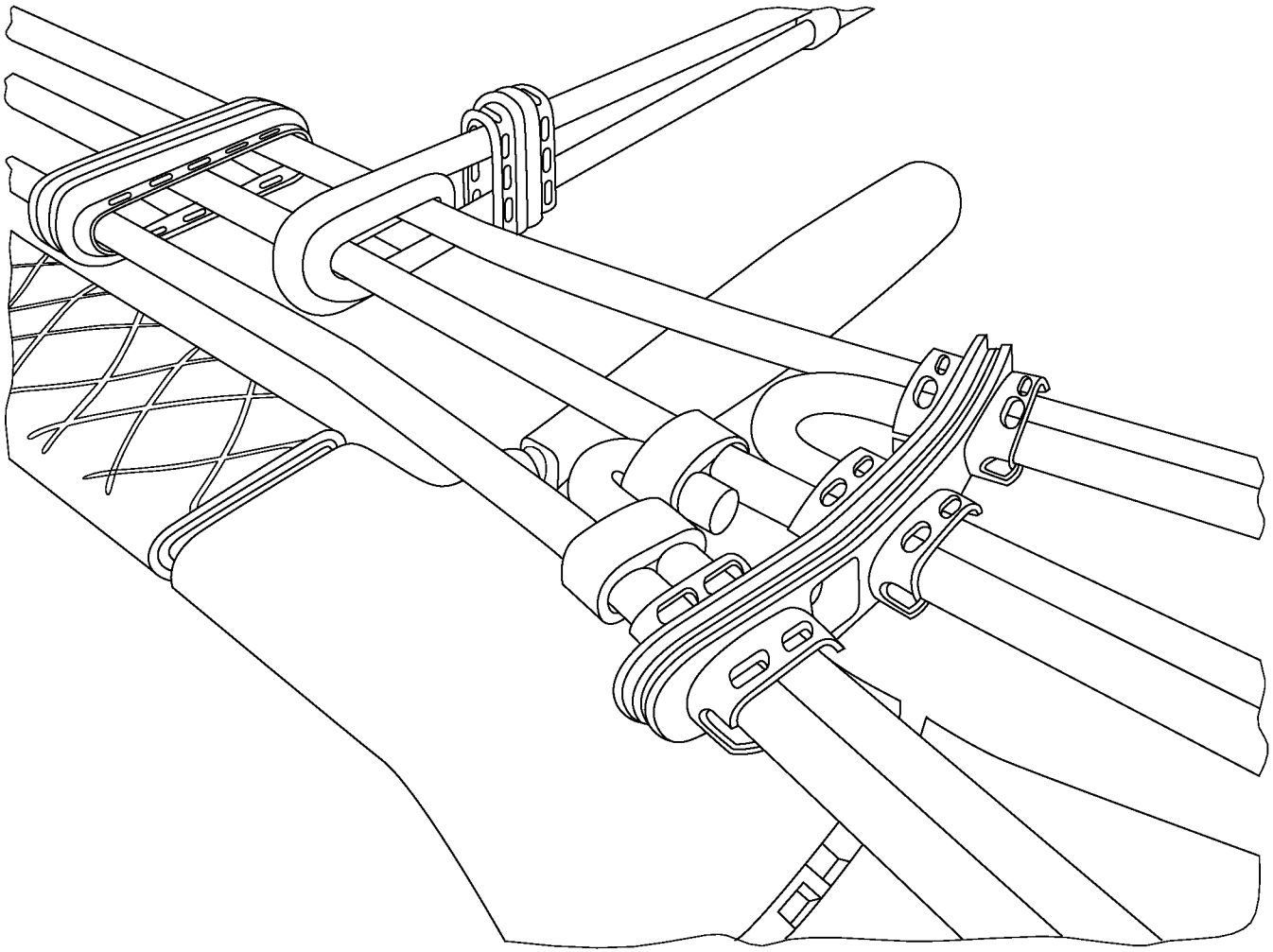
Figure 7:
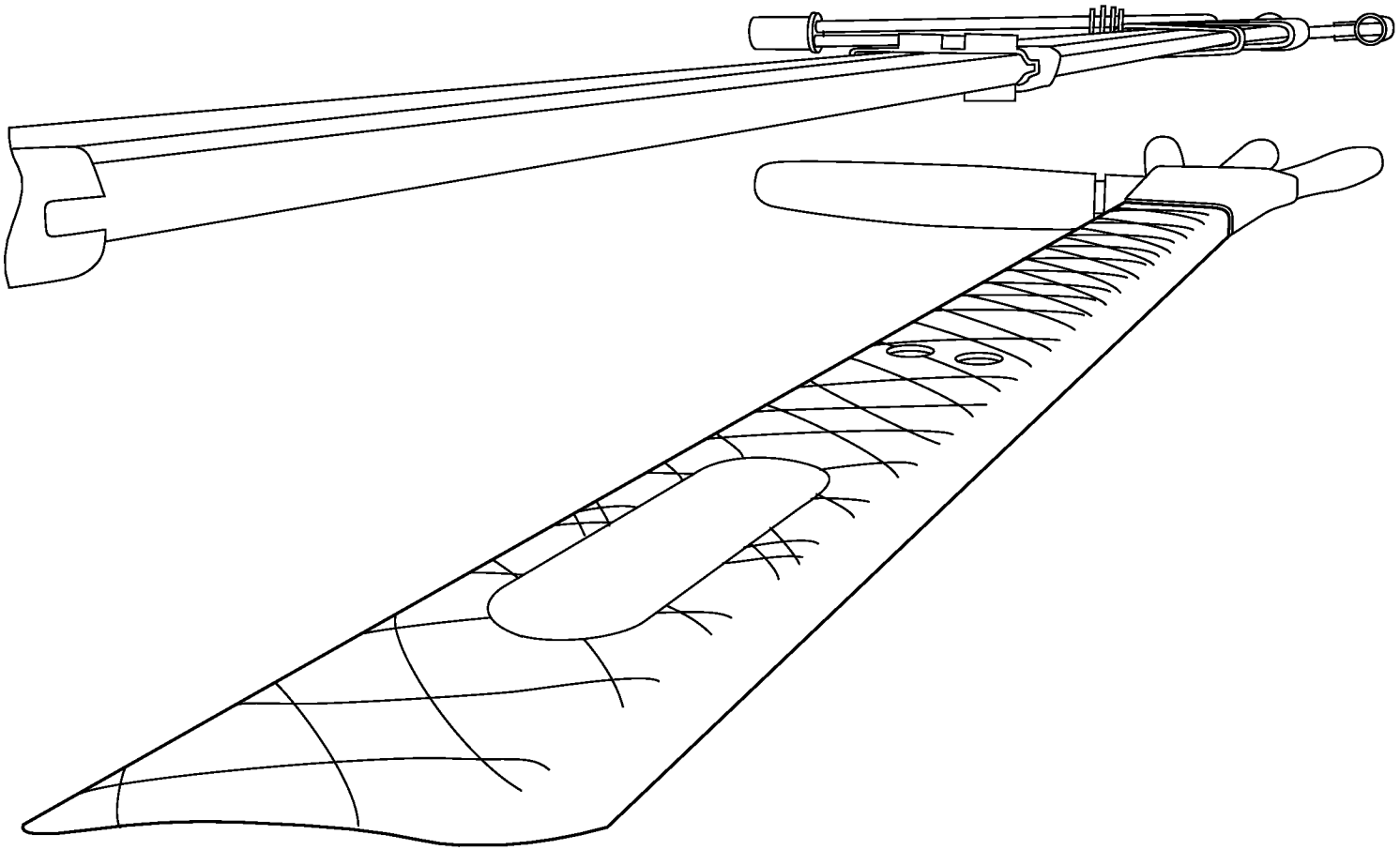

As better visible on FIG. 6, the connectors are slightly different from those illustrated in FIGS. 1 to 4. They are made from ABS (acrylonitrile butadiene styrene) by moulding or 3D-printing. The third type connector of the hand is curved to accommodate the fingers. The rods are made of a ductile aluminum allow. The position of the hard plastic connectors along the head support allows controlling where the rods can bent. The cover is made of silicone, but any rubber-like material can be used. The cover allows maintaining the different elements of the internal structure together. The maximal torsion radius of the rods can be controlled by choosing different thickness of the cover. The cover also brings comfort to physical contact with the support.

Figure 8A:
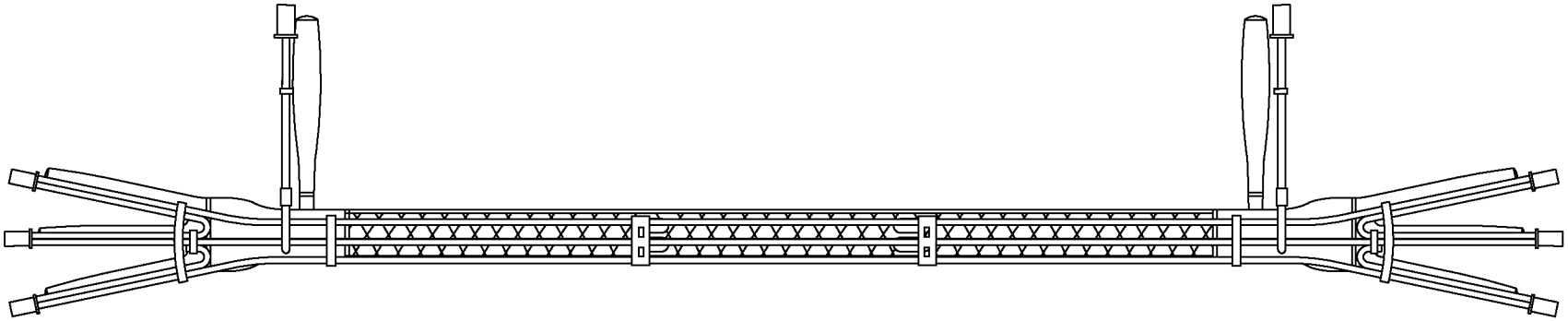
Figure 8B:
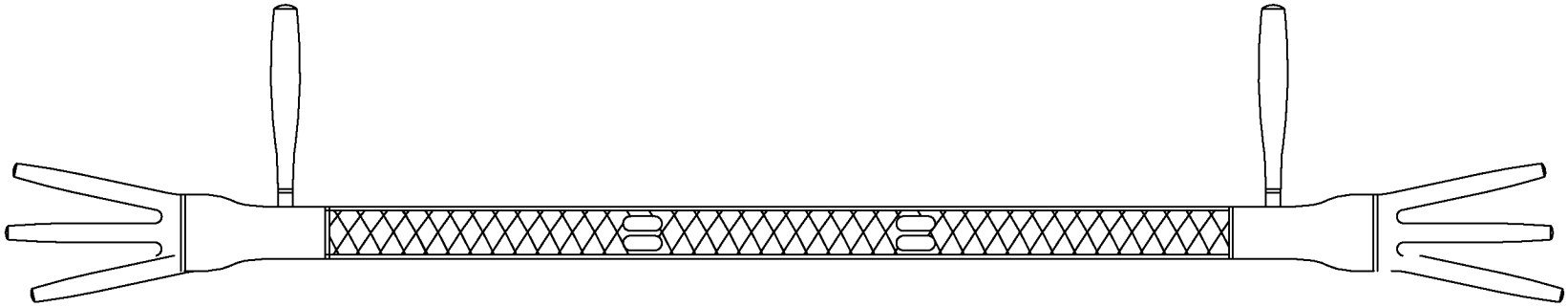
Figure 9A:
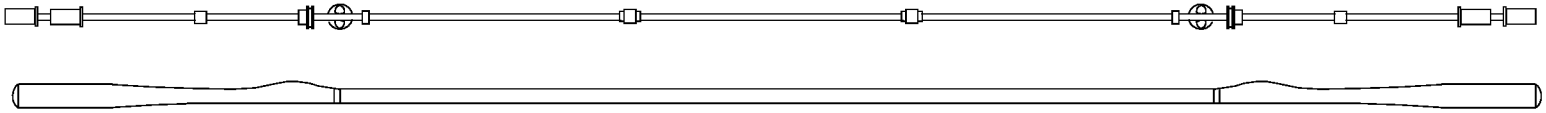
Figure 9B:
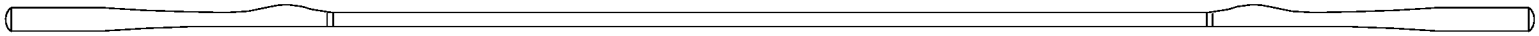
Figure 10C:
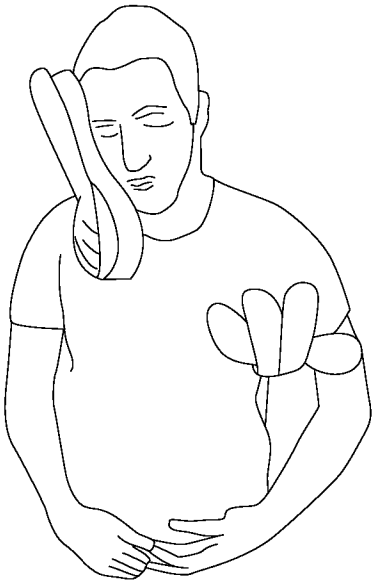
FIG. 10 illustrates a head support covered with a glove (A), and how to unfold it (B) and installed it (C) to support the head, in accordance with another preferred embodiment.
Figure 10B:
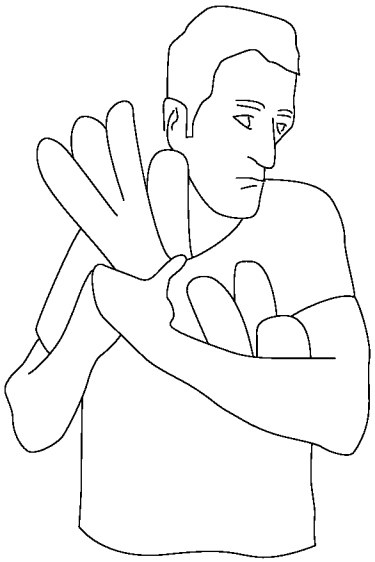
Figure 10A:
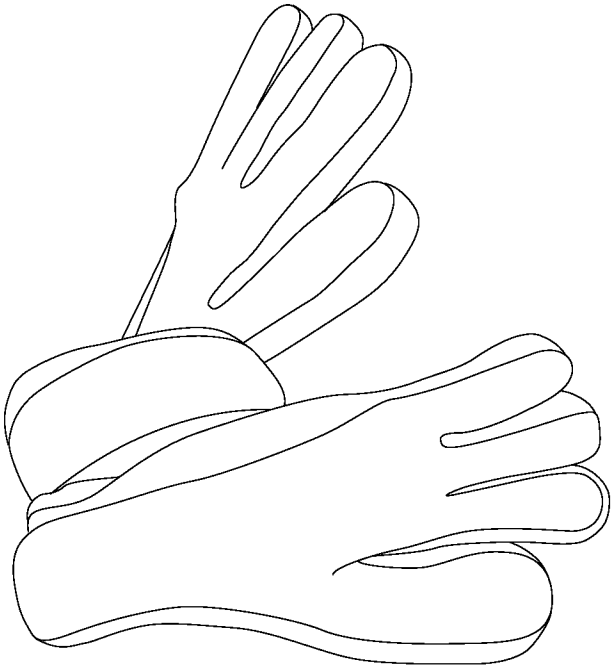
Figure 11B:
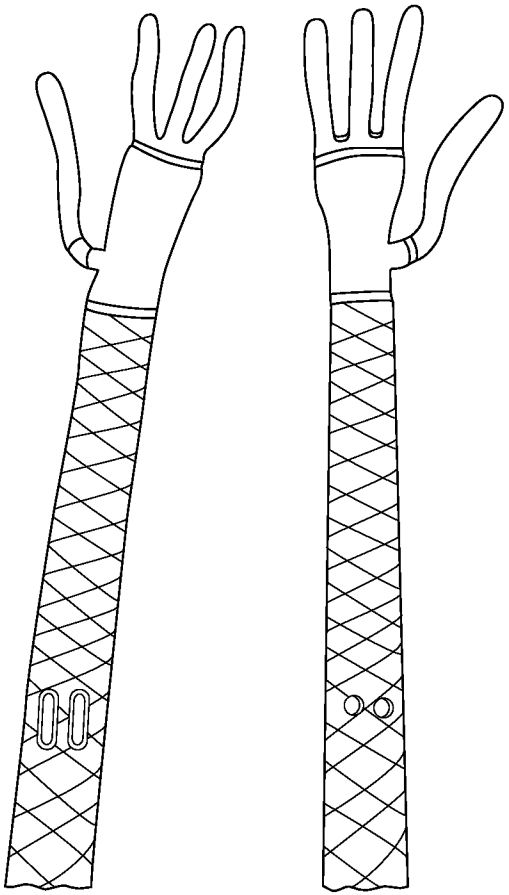
FIG. 11 illustrates different types of covers for the head support (A, B and C) and a glove (D), in accordance with other preferred embodiments.
Figure 11A:
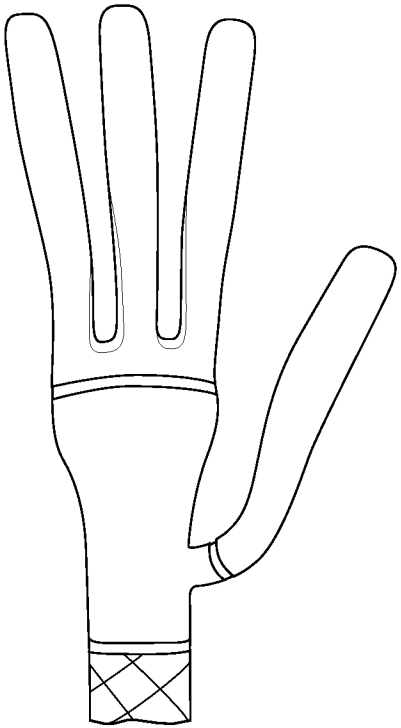
Figure 11D:
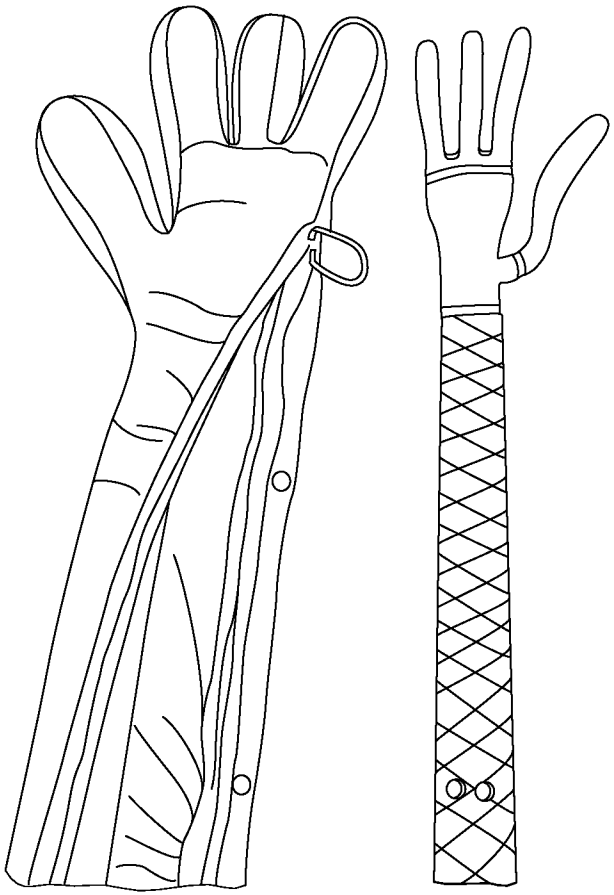
Figure 11C:
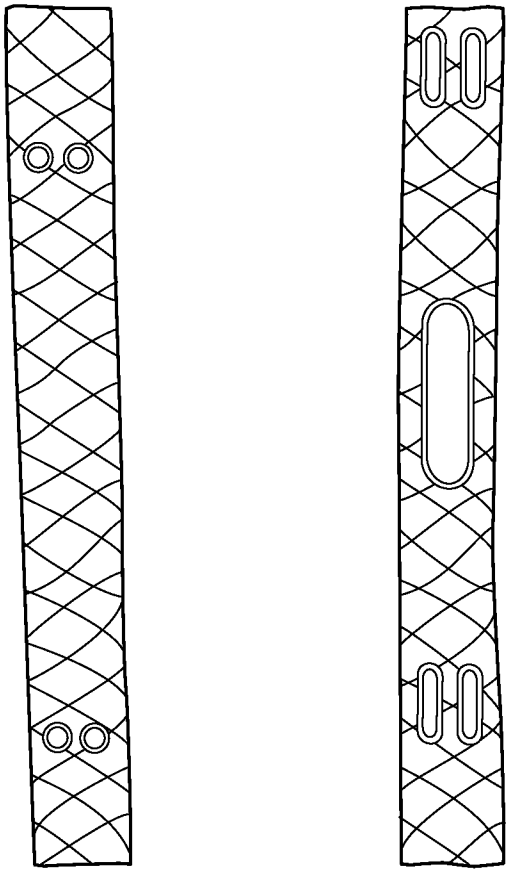

As visible on FIG. 8 (picture A) and FIG. 10 (picture C), the first type connectors are made of a unique piece of ABS plastic wrapping the rods. In comparison with the one illustrated on FIGS. 3 or 4, the opening of the connectors between the rods is circular and not oval, but their functionality is the same.

FIGS. 10 and 11 shows different types of covers used in accordance with the present invention. The cover, generally in plastic material or silicone, plays the role of the skin to maintain the internal structure of the head support. In order to add comfort, it is possible to add a glove (see FIG. 10, picture A, and FIG. 11, picture D), made of softer material such cotton, wool, polymeric fabric, etc and pad or cushions to add comfort and softness. The glove is preferably washable and provided with an aperture to install it on or remove it from the head support. Zip, buttons or Velcro™ or other known in the art of closing means can be use to close the aperture of the glove.

Such an invention is adapted to be used for different head sizes thanks to the malleable aspect of the different components. FIG. 10 shows a hear support with a glove (Picture A). A person using the support needs to unfold it and place it around the torso (Picture B) and then to adjust one the hand to comfortably support the head. One hand of the support can be used to support the head of the user while the other hand can be used to maintain the support on an external support.

Preferably, the rods of the support are made of a material that can be easily bent while resisting to opposite forces when the support supports the head. Aluminum can be used. The connectors can be also be made of aluminum but also from other materials such as hard plastic, wood, steel, etc. The cover can be made of silico, rubber-type material, fabrics or the like.

Although the present invention has been conceived to address the problem of maintaining stable the head of a kid, the invention can also be used by adults if need be.

According to another preferred embodiment, the head support as defined herein can be used in a transport vehicle, such as a train, a car, an aircraft, and preferably permanently installed on a side of each seat of the vehicle. In this case, one hand of the pair of hands of the head support is replaced with an attachment system to attach the head support to the seat.

Alternatively, the central section of the support can be inserted within a channel embedded within the seat. The channel is adapted to slidly receive the central portion of the head support with only the hand outside the seat. The extremity inside the seat may have an abutting element adapted to slide inside the cavity as for the central section. The abutting element will stop the central section to exit the channel. The user, once in the seat, can just pull the support out from the seat to use it. After use, the user can replace the head support inside the channel.

The head support can also be used to assist people in resting or sleeping in particular or extreme conditions, such as during transportation, trekking or hiking, extreme sports, military campaigns, etc . . .

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A head support comprising:

a foldable longitudinal middle section, configured to be folded between different user positions; and a first supporting section connected to a first distal extremity of the middle section, the first supporting section comprising a foldable flat surface palm section, at least two foldable longitudinal finger sections extending from a distal extremity of the flat surface palm section, and a foldable longitudinal thumb section extending from a lateral side of the foldable flat palm surface, wherein the middle section and the foldable flat surface palm section each comprise at least two foldable longitudinal rods, and wherein the middle section further comprises at least one connector configured for keeping the longitudinal rods of such middle section at a set distance from one another.

2. The head support of claim 1, wherein the longitudinal rods extend through a malleable material.

3. The head support of claim 1, wherein each of the at least two foldable longitudinal finger sections comprises at least one foldable longitudinal rod attached to and extending from each of the at least two foldable longitudinal rods of the foldable flat surface palm section.

4. The head support of claim 3, wherein the longitudinal rods extend through a malleable material.

5. The head support of claim 3, wherein the middle section further comprises at least one connector configured for keeping the longitudinal rods of such middle section at a set distance from one another.

6. The head support of claim 1, wherein the foldable longitudinal thumb section comprises at least one foldable longitudinal rod attached substantially perpendicularly to at least two of the foldable longitudinal rods of the foldable flat surface palm section.

7. The head support of claim 3, wherein the foldable longitudinal thumb section comprises at least one foldable longitudinal rod attached substantially perpendicularly to at least two of the foldable longitudinal rods of the foldable flat surface palm section.

8. The head support of claim 1, further comprising:

a second supporting section connected to a second distal extremity of the middle section, the second supporting section comprising a foldable flat surface palm section, at least two foldable longitudinal finger sections extending from a distal extremity of the flat surface palm section, and a foldable longitudinal thumb section extending from a lateral side of the foldable flat palm surface, wherein the middle section and the foldable flat surface palm sections each compromise at least two foldable longitudinal rods, and wherein the middle section further compromises at least one connector configured for keeping the longitudinal rods of such middle section at a set distance from one another.

9. The head support of claim 1, wherein each of the at least two foldable longitudinal finger sections comprises at least one foldable longitudinal rod attached to and extending from each of the at least two foldable longitudinal rods of the foldable flat surface palm section.

10. The head support of claim 9, wherein the foldable longitudinal thumb section comprises at least one foldable longitudinal rod attached substantially perpendicularly to at least two of the foldable longitudinal rods of the foldable flat surface palm section.

11. A head support comprising:

a foldable longitudinal middle section, configured to be folded between different user positions; and two supporting sections, each supporting section connected to a distal extremity of the middle section and each comprising a foldable flat surface palm section, three foldable longitudinal finger sections extending from a distal extremity of the flat surface palm section, and a foldable longitudinal thumb section extending from a lateral side of the foldable flat palm surface, and wherein the middle section and the foldable flat surface palm section each comprises three foldable longitudinal rods, wherein each of the three foldable longitudinal finger sections comprises at least one foldable longitudinal rod attached to and extending from each of the three foldable longitudinal rods of the foldable flat surface palm section.

* * * * *